US007000882B2

(12) United States Patent
Snuffer et al.

(10) Patent No.: US 7,000,882 B2
(45) Date of Patent: Feb. 21, 2006

(54) FOLDABLE TABLETOP EASEL

(76) Inventors: Denver C. Snuffer, 10885 S. State St., Sandy, UT (US) 84070; Antonio Antonelli, 2290 E. High Ridge Ln., Sandy, UT (US) 84092

( * ) Notice: Subject to any disclaimer, the term of this patent is extended or adjusted under 35 U.S.C. 154(b) by 0 days.

(21) Appl. No.: 10/729,673

(22) Filed: Dec. 4, 2003

(65) Prior Publication Data

US 2005/0121588 A1 Jun. 9, 2005

(51) Int. Cl.
*A47B 97/04* (2006.01)

(52) U.S. Cl. ..... 248/459; 248/463

(58) Field of Classification Search ..... 248/441.1, 248/459, 463; D6/300; 229/104, 112; 40/124.16, 40/124.17, 530, 745, 754, 755, 124, 124.4
See application file for complete search history.

(56) References Cited

U.S. PATENT DOCUMENTS

| | | | | | |
|---|---|---|---|---|---|
| 582,333 | A | * | 5/1897 | Wright | 248/459 |
| 773,177 | A | * | 10/1904 | Wilson | 248/459 |
| 809,785 | A | * | 1/1906 | Dahlberg | 248/459 |
| 845,694 | A | | 2/1907 | Conelly | |
| 880,049 | A | | 2/1908 | Stofflet | |
| 1,132,629 | A | * | 3/1915 | Springman | 248/459 |
| 1,399,507 | A | * | 12/1921 | Mills | 248/459 |
| 1,411,281 | A | | 4/1922 | Kellogg | |
| 1,439,719 | A | * | 12/1922 | Whipple | 248/459 |
| 1,742,854 | A | | 1/1930 | Ferguson | |
| 2,587,316 | A | | 2/1952 | Henry | 248/35 |
| 2,652,647 | A | * | 9/1953 | Suciu | 40/661.08 |
| 3,305,205 | A | | 2/1967 | Frankl | 248/459 |
| 3,762,675 | A | | 10/1973 | Sankey | 248/464 |
| 3,990,669 | A | | 11/1976 | Smith | 248/459 |
| 4,105,182 | A | | 8/1978 | Jacobson | 248/459 |
| 4,318,527 | A | | 3/1982 | Smith | 248/459 |
| 4,377,271 | A | | 3/1983 | Smith | 248/460 |
| 4,610,416 | A | | 9/1986 | Choi | 248/459 |
| 5,083,663 | A | * | 1/1992 | Conway et al. | 206/45.26 |
| 5,653,333 | A | | 8/1997 | Webster | 206/45.2 |
| 5,660,365 | A | | 8/1997 | Glick | 248/459 |
| 5,755,423 | A | | 5/1998 | Michela | 248/459 |
| 5,782,452 | A | | 7/1998 | Bosworth | 248/459 |
| 5,868,373 | A | * | 2/1999 | Duff | 248/459 |
| 5,941,496 | A | | 8/1999 | Banner | 248/459 |
| 6,237,887 | B1 | | 5/2001 | Banner | 248/459 |
| 6,270,049 | B1 | | 8/2001 | Olvey | 248/441.1 |
| 6,315,484 | B1 | | 11/2001 | Oates, Jr. | 402/79 |
| 6,382,581 | B1 | | 5/2002 | Duff | 248/459 |

* cited by examiner

*Primary Examiner*—Gwendolyn Baxter
(74) *Attorney, Agent, or Firm*—J. David Nelson

(57) ABSTRACT

A foldable tabletop easel with a pair of opposing support members rotatably connected in a vertical central joint, opposing pedestal members rotatably attached to the lower vertical portion of the outside edges of the respective support members and a positioning tab connected to one of the support members in a tab insert adjacent to the central joint. The positioning tab has slots which secure the easel in a display position as the positioning tab is rotated onto a tab rib in a tab insert in the other support member. The easel can be of unitary construction of cardboard.

23 Claims, 3 Drawing Sheets

FOLDABLE TABLETOP EASEL

FIELD OF THE INVENTION

This invention is in the field of devices for holding and displaying display items such as posters and books, and, in particular, is in the field of easels.

BACKGROUND OF THE INVENTION

Various devices are disclosed in the prior art for holding and displaying posters, works of art, photos, business charts, books and other display items for presentations, exhibitions and other purposes. Floor or table standing easels, commonly constructed of tubular and other structural components which may be of metal, plastic or other materials, or combinations thereof, have long been used for such applications. These devices are relatively expensive, bulky, heavy and not particularly easy to use.

A number of devices are also disclosed in the prior art which attempt to provide a less expensive, lighter, and less bulky means for holding and displaying such items. A number of such devices, particularly tabletop easels, have been designed to be constructed principally of corrugated paperboard or other types of cardboard or other lightweight, inexpensive materials and some have been designed to be more or less foldable, to make them less bulky for transport.

An object of the present invention is to provide an inexpensive, simple, stable tabletop easel which is foldable to a compact configuration for transport.

A further object of the present invention is to provide a tabletop easel that can be constructed of a unitary panel of corrugated paperboard or other types of cardboard or other common, inexpensive material.

SUMMARY OF THE INVENTION

A preferred embodiment of the easel of the present invention is comprised of a left support member, a right support member, a left pedestal member, a right pedestal member and a positioning tab. The left support member is rotatably connected to the right support member in a vertical central joint. A left pedestal member is rotatably connected to the left vertical lower portion of the left support member. Similarly the right pedestal member is rotatably connected to the right vertical lower portion of the right support member. Left edge tapering and right edge tapering, for some preferred embodiments, will be uniform from the left pedestal top and the right pedestal top respectively to the left support member top and the right support member top. These embodiments are particularly suited for displaying flat objects such as pictures, posters and other types of artwork or displays in sheet form. For certain preferred embodiments the pedestal angle between the pedestal top and the tapered outside edge for both the left support member and the right support member will be approximately 90°. The outside edge tapering and the pedestal top slope provide for a stable display of most display items.

When the left support member and right support member are rotated to the desired support angle and the positioning tab is lowered from an unlocked position to a locked position, a selected tab slot in the peripheral edge of the positioning tab rotates onto a tab rib thereby securing the support members at the desired support position with the desired support angle between the left support member and the right support member. The positioning tab is rotatably attached to the left support member or the right support member in a horizontal tab joint. When the positioning tab is in the unlocked position, the tab attached end lies within and conforms to the attachment insert. Similarly, when the left support member and right support member are aligned in a flat position, the tab free end fits within a receiving insert which is the tab insert opposite the attachment insert. The tab free end is not attached to either support member. This allows the free end to extend rearward behind a support member as the right support member and the left support member are rotated toward a display configuration.

A semi-circular positioning tab with a vertical tab end provides for the free rotation of the positioning tab from the unlocked position to the locked position with the tab free end freely rotating in the receiving insert and the selected tab slot readily rotating onto the tab rib until the positioning tab is in the locked position. The depth of the tab slots is preferably equal to the width of the tab rib, thereby providing additional friction to hold the positioning tab in the locked position. Also the positioning tab can be rectangular or in other geometric shapes. The shape of the tab used and the resultant shape of the receiving insert must provide for clearance of the tab top as it is rotated from the unlocked position to the locked position for the various support angles. The semi-circular design is a preferred embodiment because it provides for adequate clearance between the tab top and the tab insert top regardless of the support angle.

Preferred embodiments may also be provided with a horizontal left panel joint and a horizontal right panel joint which are aligned as they intersect the vertical central joint. For embodiments constructed of corrugated paperboard or other types of material collectively and commonly referred to along with corrugated paperboard as cardboard, these joints may be accomplished by scoring on the back side of the easel material. Depending upon the material used, other suitable hinge means are known in the industry. This allows the left support member top and the right support member top to be rotated downward to a compact configuration, thereby providing a more sturdy configuration for the display of heavier and more compact materials such as books. It should be noted, however, that in this compact configuration the positioning tab is not used. Other embodiments may also provide for the use of a positioning tab and tab insert at each of the vertical pedestal joints. This provides for additional stability, particularly for displaying heavier display items or very light display items.

DETAILED DESCRIPTION

Figure 1:
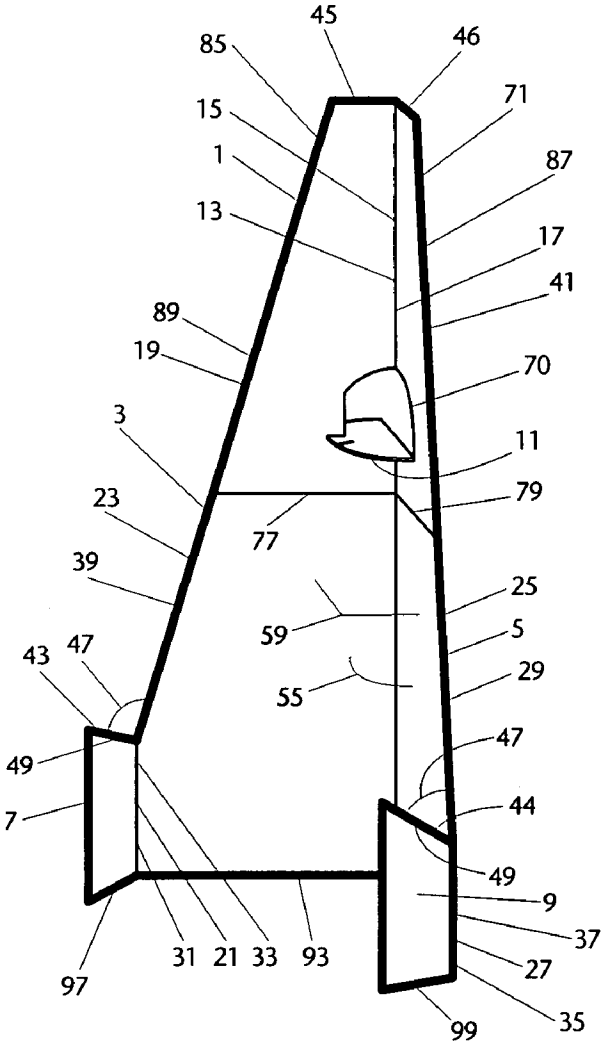
FIG. 1 is a front perspective view of a preferred embodiment of the easel of the present invention in a display configuration with top support member panels in a full display position.

Referring first to FIG. 1 the preferred embodiment of the easel 1 of the present invention shown is comprised of a left support member 3, a right support member 5, a left pedestal member 7, a right pedestal member 9 and a positioning tab 11. The left support member inside edge 13 is rotatably connected to the right support member inside edge 15 in a vertical central joint 17. The left support member has a left outside edge 19 which has a left vertical lower portion 21 and a left tapered upper portion 23. Similarly the right support member has a right outside edge 25 which has a right vertical lower portion 27 and a right tapered upper portion 29. The left pedestal member inside edge 31 is rotatably connected to the left vertical lower portion in a vertical left pedestal joint 33. Similarly the right pedestal member inside edge 35 is rotatably connected to the right vertical lower portion in a vertical right pedestal joint 37. The left edge tapering 39 and the right edge tapering 41, for some preferred embodiments, will be uniform from the left pedestal top 43 and the right pedestal top 44 respectively to the left support member top 45 and the right support member top 46 as shown in FIG. 1. Also for some preferred embodiments the left edge tapering and right edge tapering will be the same. These embodiments are particularly suited for displaying flat objects such as pictures, posters and other types of artwork or displays in sheet form. Also for certain preferred embodiments the pedestal angle 47 between the pedestal top and the tapered outside edge for both the left support member and the right support member will be approximately 90°. The outside edge tapering and the pedestal top slope 49 provide for a stable display of most common sized display boards, posters, charts and similar display items.

Figure 4:
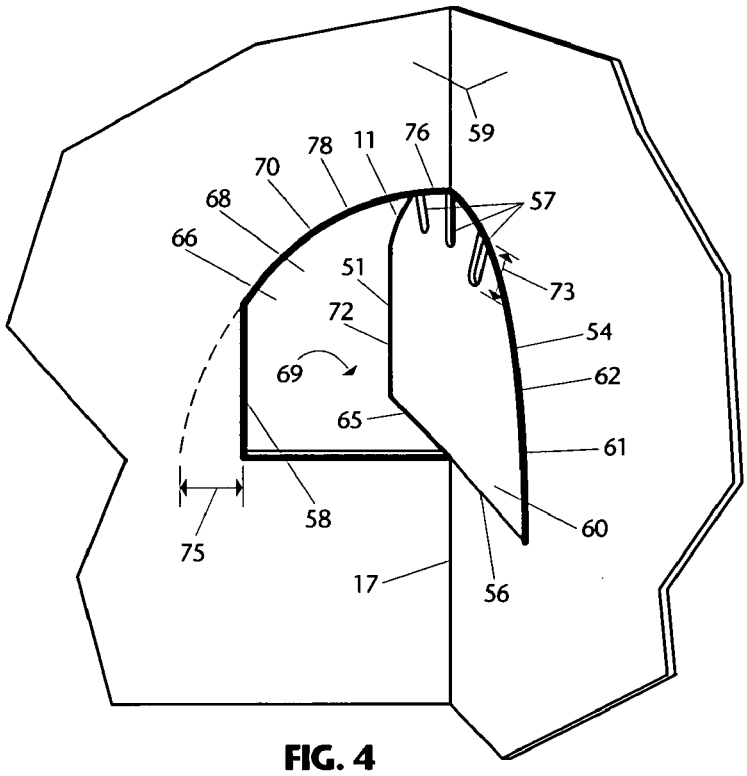
FIG. 4 is a front view perspective of a preferred embodiment of the positioning tab of the present invention in an unlocked position.
Figure 5:
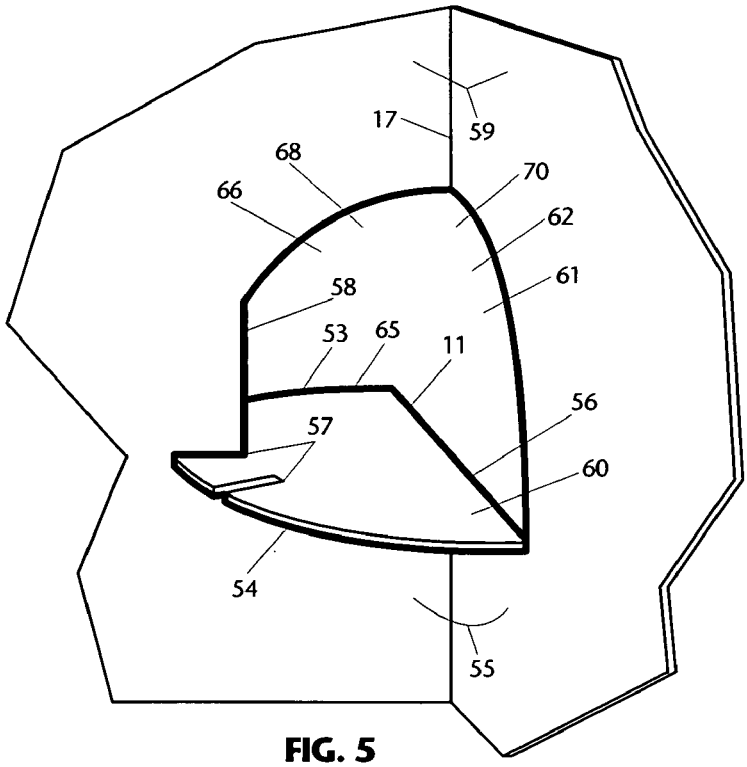
FIG. 5 is a front view perspective of a preferred embodiment of the positioning tab of the present invention in a locked position.

Referring now to FIG. 4 and FIG. 5 respectively, a preferred embodiment of the positioning tab 11 is shown. In FIG. 4 the positioning tab is shown in the unlocked position 51, while in FIG. 5 the positioning tab is shown in the locked position 53. Referring also to FIG. 1, when the left support member and right support member are rotated to the desired support angle 55 and the positioning tab is lowered from the unlocked position 51 to the locked position 53, a selected tab slot 57 in the tab peripheral edge 54 is rotated onto the tab rib 58 thereby securing the support members at the desired support position 59 with the desired support angle 55. For the embodiment shown the positioning tab is rotatably attached to the right support member in a horizontal tab joint 56. When the positioning tab is in the unlocked position the tab attached end 60 lies within and conforms to the attachment insert 61 which, for the embodiment shown is the right tab insert 62.

Figure 3:
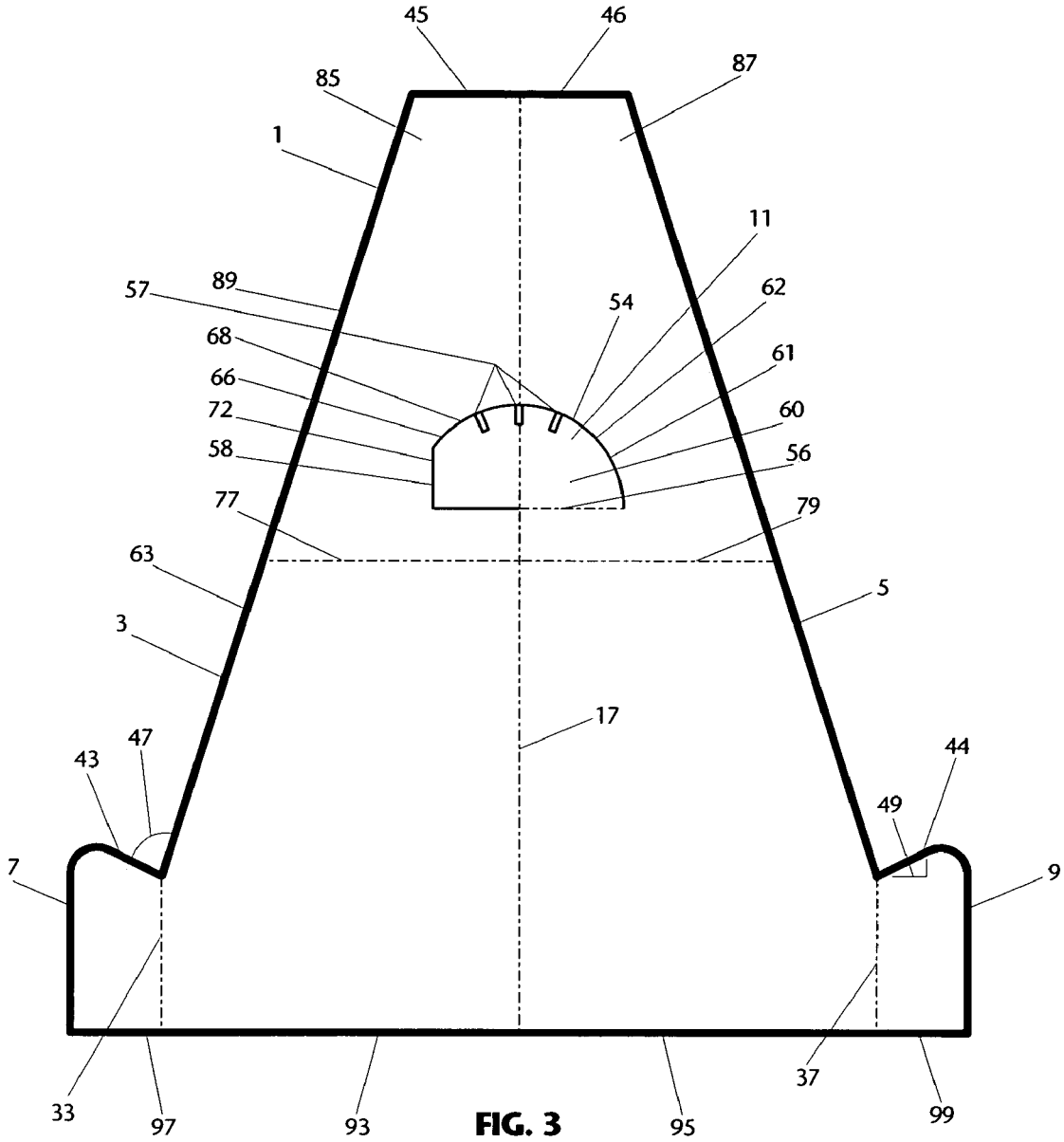
FIG. 3 is a front view of a preferred embodiment of the easel of the present invention in a flat configuration.

Similarly, when the left support member and right support member are aligned in a flat position 63 as shown in FIG. 3, the tab free end 65 fits within the receiving insert 66 which, for the embodiment shown, is the left tab insert 68 in the left support member adjacent to the vertical central joint 17. The left tab insert and the right tab insert together form a central tab insert 70. The tab free end is not attached to the left support member. This allows the free end to extend rearward 69 behind the left support member as the right support member and the left support member are rotated toward a display configuration 71 as shown in FIG. 1. For the preferred embodiment of the positioning tab shown in FIG. 3, FIG. 4, and FIG. 5, a semi-circular positioning tab 11 with a vertical tab end 72 provides for the free rotation of the positioning tab from the unlocked position 51 to the locked position 53 with the tab free end freely rotating in the receiving insert and the selected tab slot readily rotating onto the tab rib 58 until the positioning tab is in the locked position 53. The depth of the tab slots 73 is preferably equal to the tab rib width 75, thereby providing additional friction to hold the positioning tab in the locked position.

The embodiment of the positioning tab shown in the figures, could readily be reversed with the left end being rotatably attached to the left support member and the tab rib being integral with the right tab insert, i.e. a mirror image of the positioning tab as shown in the figures. Also the positioning tab can be rectangular, oval, triangular or have other geometric shapes. Referring to FIG. 4, the shape of the positioning tab used and the resultant shape of the receiving insert must provide for clearance of the tab top 76 as it is rotated from the unlocked position to the locked position for the various support angles 55. The semi-circular design shown in the figures is a preferred embodiment because it provides for adequate clearance between the tab top 76 and the tab insert top 78 regardless of the support angle.

Figure 2:
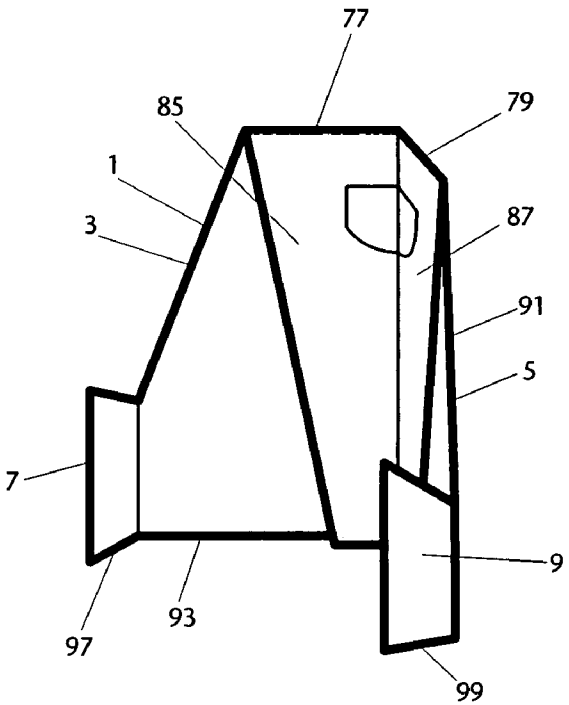
FIG. 2 is a front perspective view of a preferred embodiment of the easel of the present invention in a display configuration with top support member panels in a compact display position.

Preferred embodiments may also be provided with a horizontal left panel joint 77 and a horizontal right panel joint 79 which are aligned as they intersect the vertical central joint 17 as shown in FIGS. 1,2 and 3. For embodiments constructed of corrugated paperboard or other types of material collectively and commonly referred to along with corrugated paperboard as cardboard, these joints may be accomplished by scoring on the back side of the easel material. Depending upon the material used, suitable hinge material mechanisms are also known in the industry. This allows the left support member top panel 85 and the right support member top panel 87 to be rotated from a full display position 89 as shown in FIGS. 1 and 3 downward to a compact configuration 91 as shown in FIG. 2 thereby providing a more sturdy configuration for the display of heavier and more compact materials such as books. It should be noted, however, that in this compact configuration the positioning tab is not used.

Referring to FIG. 1, FIG. 2 and FIG. 3, it will be noted that the vertical central joint 17 and the vertical pedestal joints 33, 37 provide for the alinement of the left support member base 93, the right support member base 95, the left pedestal base 97, and the right pedestal base 99 whether the easel is in a flat configuration or a display configuration, thereby providing a stable base for the easement on a level surface regardless of the support angle 55.

Other embodiments, particularly in larger sizes, may also provide for the use of a positioning tab and tab insert at each of the vertical pedestal joints. This provides for additional stability, particularly for displaying heavier display items or very light display items.

Other objects, features and advantages of the present invention will become apparent from the preceding detailed description considered in connection with the accompanying drawings. It is to be understood, however, that the drawings and the foregoing description are designed as an illustration only and not as a definition of the limits of the invention. Therefore, the foregoing is intended to be merely illustrative of the invention and the invention is limited only by the following claims.

What is claimed is:

1. Foldable easel for use on a level surface, the easel comprising a pair of opposing support members, a pair of opposing pedestal members and a positioning tab, each support member having a lower portion, a respective pedestal member being attached to the lower portion of a respective said support member, the support members being rotatably connected in a vertical central joint and having an unfolded flat position and one or more display positions wherein the support members are rotated forward in the vertical central joint to a display position, the positioning tab having an attachment end rotatably attached to one of the support members in a generally horizontal tab joint which is adjacent to and generally perpendicular to the central joint and the opposing support member having a receiving insert adjacent to the central joint and opposing the positioning tab attachment end, the receiving insert having a generally vertical tab rib on the end of the receiving insert opposite the central joint, the positioning tab having a free end, the positioning tab having a peripheral edge with one or more tab slots in the peripheral edge, the positioning tab and the receiving insert being dimensioned to provide for the positioning tab to rotate into the receiving insert and a respective tab slot to rotate onto the tab rib when the support members are rotated forward to the display position.

2. Easel as recited in claim 1 wherein the positioning tab is semi-circular with a tab edge which is more or less vertical on the free end, the receiving insert encompassing the free end when the easel is in a flat position.

3. Easel as recited in claim 1 wherein the support member that the positioning tab is attached to has an attachment insert contiguous to the receiving insert, the attachment insert having a horizontal insert base and the attachment end of the positioning tab having a horizontal tab edge, the insert base being rotatably attached to the tab edge in the horizontal tab joint and the attachment insert encompassing the attachment end when the easel is in a flat position.

4. Easel as recited in claim 1 wherein the tab slots are dimensioned to fit snugly on the tab rib as the support members are rotated from the flat position to the display position and the positioning tab is rotated from an unlocked position to a locked position.

5. Easel as recited in claim 1 wherein the opposing support members comprise a left support member and a right support member, and wherein the left support member is divided into a left top panel and left bottom panel, the left top panel and the left bottom panel being rotatably connected in a horizontal left panel joint, and wherein the right support member is divided into a right top panel and right bottom panel, the right top panel and the right bottom panel being rotatably connected in a horizontal right panel joint.

6. Easel as recited in claim 1 wherein the easel is of unitary construction.

7. Easel as recited in claim 6 wherein the easel is constructed of plastic.

8. Easel as recited in claim 6 wherein the easel is constructed of cardboard.

9. Easel as recited in claim 1 wherein the easel is of unitary construction with the joints formed by scoring of the easel material.

10. Easel as recited in claim 9 wherein the easel is constructed of cardboard.

11. Easel as recited in claim 9 wherein the easel is constructed of plastic.

12. Easel as recited in claim 1 wherein each said pedestal member has a pedestal top, each said support member has an outside edge with a tapered upper portion which tapers from the respective pedestal top inwardly toward the central joint, and each said pedestal top is roughly perpendicular to the tapered upper portion of the support member to which said pedestal member is attached.

13. Easel as recited in claim 1 wherein each said support member has an outside edge with a vertical lower portion and a tapered upper portion and each respective said pedestal member is rotatably attached to the vertical lower portion of the respective support member in a vertical pedestal joint.

14. Foldable easel for use on a level surface, the easel comprising:

a) pair of opposing support members, namely a left support member and right support member, the left support member and right support member being rotatably connected at a vertical central joint, the support members having an unfolded flat position and one or more display positions wherein the support members are rotated forward in the vertical central joint to a display position, the left support member having a left outside edge, the left outside edge having a left outside edge lower portion which is vertical and the left outside edge having a left outside edge upper portion which tapers from the top of the vertical lower portion inwardly toward the central joint, the right support member having a right outside edge, the right outside edge having a right outside edge lower portion which is vertical, the right outside edge having a right outside edge upper portion which tapers from the top of the vertical lower portion inwardly toward the central joint, the left support member having a left tab insert, the right support member having a right tab insert, the left tab insert being contiguous to the right tab insert at the vertical central joint, the left tab insert and the right tab insert together forming a central tab insert;

b) pair of opposing pedestal members, namely a left pedestal member and a right pedestal member, the left pedestal member being rotatably connected to the vertical lower portion of the left outside edge in a left pedestal joint and the right pedestal member being rotatably connected to the vertical lower portion of the right outside edge in a right pedestal joint, each said pedestal member having a top edge which is roughly perpendicular to the tapered upper portion of the support member to which said pedestal member is rotatably connected; and c) positioning tab, the positioning tab being dimensioned to be encompassed by the central tab insert when the easel is in an unfolded, flat position, the positioning tab having an attachment end which is rotatably connected in a generally horizontal tab joint to an attachment insert, the attachment insert being the left tab insert or the right tab insert, the positioning tab having a generally vertical free end with a peripheral edge having one or more tab slots, a receiving insert, the tab insert opposing the attachment insert, having a tab rib, the positioning tab and the receiving insert being dimensioned to provide for the positioning tab to rotate into the receiving insert and a respective tab slot to rotate onto the tab rib when the support members are rotated forward to the display position.

15. Easel as recited in claim 14 wherein the positioning tab is semi-circular with a tab edge which is more or less vertical on the free end.

16. Easel as recited in claim 14 the tab slots are dimensioned to fit snugly on the tab rib as the left support member and right support member are rotated from the flat position to the display position and the positioning tab is rotated from an unlocked position to a locked position.

17. Easel as recited in claim 14 wherein the left support member is divided into a left top panel and left bottom panel, the left top panel and the left bottom panel being rotatably connected in a horizontal left panel joint, and wherein the right support member is divided into a right top panel and right bottom panel, the right top panel and the right bottom panel being rotatably connected in a horizontal right panel joint.

18. Easel as recited in claim 14 wherein the easel is of unitary construction.

19. Easel as recited in claim 18 wherein the easel is constructed of cardboard.

20. Easel as recited in claim 18 wherein the easel is constructed of plastic.

21. Easel as recited in claim 14 wherein the easel is of unitary construction with the joints formed by scoring of the easel material.

22. Easel as recited in claim 21 wherein the easel is constructed of cardboard.

23. Easel as recited in claim 21 wherein the easel is constructed of plastic.

* * * * *